United States Patent [19]

Gretsch et al.

[11] Patent Number: 4,612,840

[45] Date of Patent: Sep. 23, 1986

[54] MUSICAL INSTRUMENT WITH A PLURALITY OF STRINGS

[75] Inventors: Fred W. Gretsch; Roy D. Cook, both of Ridgeland, S.C.; Bobby C. Iler, Brooklet, Ga.

[73] Assignee: Fred W. Gretsch Enterprises, Ltd., Ridgeland, S.C.

[21] Appl. No.: 543,305

[22] Filed: Oct. 19, 1983

[51] Int. Cl.[4] ..... G10D 1/10; G10D 3/12; G10D 3/14

[52] U.S. Cl. ..... 84/269; 84/300; 84/312 R

[58] Field of Search ..... 84/269, 300, 312 R

[56] References Cited

U.S. PATENT DOCUMENTS

| | | | |
|---|---|---|---|
| 215,647 | 5/1879 | McManus | 84/269 |
| 226,621 | 4/1880 | McQuilkin | 84/269 |
| 288,679 | 11/1883 | Tallmadge | 84/269 |
| 437,604 | 9/1890 | Kelly | 84/269 |
| 1,291,903 | 1/1919 | Isham | 84/269 |
| 4,060,018 | 11/1977 | Gilbrech | 84/269 |
| 4,469,001 | 9/1984 | Hartry | 84/269 |

*Primary Examiner*—Benjamin R. Fuller
*Attorney, Agent, or Firm*—Benjamin G. Weil

[57] ABSTRACT

A musical instrument with a plurality of strings comprises a body assembly, a neck, and a headpiece, with the body assembly comprising a cylindrical body, a membrane covering the top of the cylindrical body, and a head rim extending along the circumference of the top of the cylindrical body holding the membrane over the cylindrical body, with a plurality of tuning lug assemblies secured into the side of the head rim.

17 Claims, 10 Drawing Figures

MUSICAL INSTRUMENT WITH A PLURALITY OF STRINGS

BACKGROUND OF THE INVENTION

This invention relates to an improvement in a musical instrument with a plurality of strings, and more particularly to an improvement designed to give a unique sound with unique adjusting features.

Presently, in a banjo, which is a musical instrument with a plurality of strings, the height of the banjo head membrane is below that of the banjo head rim. In the present invention, a musical instrument with a plurality of strings provides for the height of the head membrane to be above the head rim and tightening apparatus. A unique sound and unique adjusting features are incorporated into the present invention.

OBJECTS OF THE INVENTION

An object of the present invention is to provide a musical instrument with a plurality of strings with a head membrane which can be adjusted from the bottom of the body assembly.

Another object of the present invention is to provide head rim hook slots on the head rim of the body assembly of the musical instrument with a plurality of strings.

Still another object of the present invention is to provide a plurality of hooks fitting into a plurality of head rim hook slots to adjust the tension on the head membrane from the side of the head rim.

A further object of the present invention is to provide an adjusting feature in which the height of the head membrane is higher than the height of the head rim.

Another object of the present invention is to provide a tailpiece which is adjustable side-to-side allowing for proper string alignment with the neck of the musical instrument with a plurality of strings.

Still another object of the present invention is to provide a musical instrument with a plurality of strings made essentially by combining a banjo neck with a banjo body assembly similar to a tamborine, but with unique adjusting features.

SUMMARY OF THE INVENTION

Briefly, the invention is a musical instrument with a plurality of strings comprising a body assembly, a neck and a headpiece. The plurality of strings is secured on the body assembly. The neck is rigidly secured to the body assembly. The plurality of strings passes over the neck. The headpiece is rigidly secured to the neck. The plurality of strings is adjustably secured on the headpiece. The body assembly comprises a cylindrical body and a membrane covering the top of the cylindrical body. A head rim extends along the circumference of the top of the cylindrical body hold the membrane over the cylindrical body. A plurality of tuning lug assemblies is secured into the side of the head rim. The plurality of tuning lug assemblies is operational to adjust the tightness or looseness of the head rim holding the membrane. The adjustment by the plurality of tuning lug assemblies may be made from the bottom of the body assembly, thereby adjusting the sound made by the musical instrument with the plurality of strings.

The head rim comprises a plurality of connection slots in the outer side of the head rim. The plurality of tuning lug assemblies has a plurality of hooked sections which fit into the plurality of connection slots. The tuning lug assemblies are individually adjustable to tune the sound made by the musical instrument with the plurality of strings.

Each of the plurality of tuning lug assemblies comprises a tuning lug screw, an adjusting screw nut, and holding means. The tuning lug screw comprises one of a plurality of hooked sections. The tuning lug screw is adjustably secured into the adjusting screw nut. The holding means has a first section which is around the adjusting screw nut, pressing downward thereon. The holding means has a second section which is secured under the bottom of the cylindrical body. The holding means is operative to move adjustably with the movement of the adjusting screw nut and the tuning lug screw.

The tuning lug screw further comprises a shaft which is rigidly connected to one of the plurality of hooked sections, and a threaded portion rigidly connected to the shaft. The adjusting screw nut comprises an upper shaft with internal threads within which the threaded portion of the tuning lug screw is adjustably secured. The adjusting screw nut has an enlarged base with internal threads against which the first section of the holding means may press downward. The adjusting screw nut further comprises a screwdriver slot in the bottom of the enlarged base whereby the adjusting screw nut may be adjusted by a screwdriver.

The first section of the holding means is rigidly secured to the second section. The second section has an upper extension rigidly secured thereto and operative to press against the side of the cylindrical body while the second section is secured under the bottom of the cylindrical body.

The body assembly further comprises a tailpiece on which the plurality of strings is adjustably secured. The tailpiece is adjustably mounted and moveable to align the plurality of strings with the neck over which the plurality of strings passes. The tailpiece further comprises a vertical portion with a slotted opening. The body further comprises a tailpiece lug assembly adjustably secured to the body assembly and to the tailpiece.

The tailpiece lug assembly comprises a tailpiece tuning lug screw, a tailpiece adjusting screw nut, and tailpiece holding means. The tailpiece lug screw comprises a tailpiece hooked section. The tailpiece tuning lug is adjustably secured in the tailpiece adjusting screw nut. The tailpiece holding means has a tailpiece first section and a tailpiece second section. The tailpiece first section is secured around the tailpiece adjusting screw nut, pressing downward thereon. The tailpiece second section is secured under the bottom of the cylindrical body. The tailpiece holding means is operative to move adjustably with the movement of the tailpiece adjusting screw nut and the tailpiece tuning lug screw.

The tailpiece tuning lug screw further comprises a tailpiece shaft rigidly connected to the tailpiece hooked section and a tailpiece threaded portion rigidly connected to the tailpiece shaft. The tailpiece adjusting screw nut comprises a tailpiece upper shaft with tailpiece internal threads within which the tailpiece threaded portion of the tailpiece tuning lug screw is adjustably secured. The tailpiece adjusting screw nut has a tailpiece enlarged base with tailpiece internal threads against which the tailpiece first section of said tailpiece holding means may press downward. The tailpiece adjusting screw nut further comprises a tailpiece screwdriver slot in the bottom of the tailpiece enlarged base wherein the tailpiece adjusting screw nut may be adjusted by a screwdriver.

The tailpiece first section of the tailpiece holding means is rigidly secured to the tailpiece second section. The tailpiece second section has a tailpiece upper extension rigidly secured thereto and operative to press against the side of the cylindrical body while the tailpiece second section is secured under the bottom of the cylindrical body. When the musical instrument is resting on a horizontal surface, the membrane is higher vertically than the plurality of tuning lug assemblies which are secured into the side of the head rim.

BRIEF DESCRIPTION OF THE DRAWINGS

The invention will be more fully understood from the following detailed description and appended claims when taken with the drawings in which:

DETAILED DESCRIPTION OF PREFERRED EMBODIMENTS OF THE INVENTION

Figure 1:
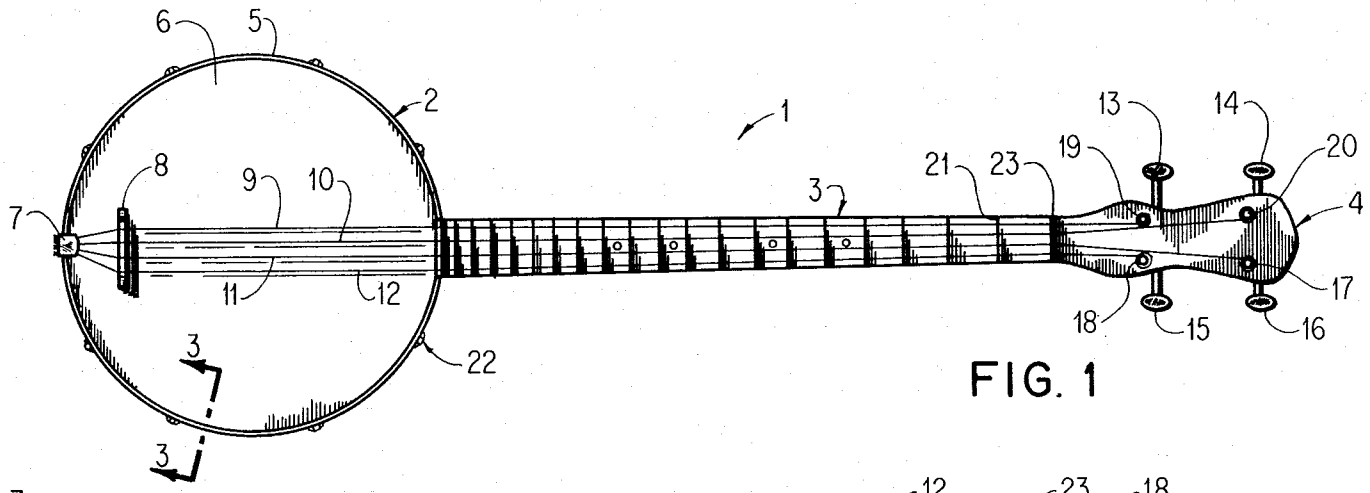
FIG. 1 is a top elevational view of banjo 1.

Referring now to the drawings, FIG. 1 is a top elevational view of banjo 1. Banjo 1 has a banjo body assembly 2 secured to a banjo neck 3. Banjo headpiece 4 is connected to banjo neck 3. Banjo head rim 5 extends along the entire circumference of the upper portion of banjo body assembly 2. Banjo head membrane 6 covers banjo body assembly 2 and is held securely by the banjo head rim 5. Tailpiece 7 is secured at the rear of banjo body assembly 2, aligned with the banjo neck 3. Bridge 8 is secured onto the banjo head membrane 6 on banjo body assembly 2.

A plurality of strings 9, 10, 11, and 12 are shown extending from tailpiece 7, across bridge 8, and extending along the banjo neck 3. String 9 is secured by tuning pin 19. String 10 is secured by tuning pin 20. String 11 is secured by tuning pin 17. String 12 is secured by tuning pin 18. String 9 on tuning pin 19 may be adjusted by tuning key 13. String 10 on tuning pin 20 may be adjusted by tuning key 14. String 11 on tuning pin 17 may be adjusted by tuning key 16. String 12 on tuning pin 18 may be adjusted by tuning key 15.

A plurality of four strings is shown in the drawings. The invention is suitable for a musical instrument with any number of strings desired, including a four-string, five-string, or six-string instrument. A plurality of strings 9, 10, 11, and 12 extends across a plurality of frets, such as fret 21. A plurality of tuning lug assemblies, such as tuning lug assembly 22, is located along the cicrumference of banjo body assembly 2.

Figure 2:
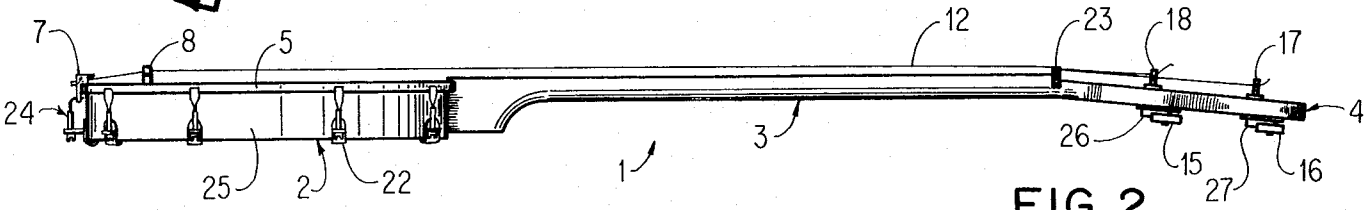
FIG. 2 is a side elevational view of banjo 1.

FIG. 2 is a side elevational view of banjo 1. String nut 23 is located between the plurality of frets, such as fret 21, and the plurality of tuning pins 17, 18, 19, and 20. The tailpiece lug assembly 24 secures tailpiece 7 to the banjo body assembly 2. The banjo body assembly 2 has a banjo body 25.

The tuning keys 13, 14, 15, and 16 have gears, such as tuning key gear 26 on tuning key 15 and tuning key gear 27 on tuning key 16. The tuning key gear 26 enables tuning key 15 to loosen or tighten the string 12 on tuning pin 18. The tuning key gear 27 enables tuning key 16 to loosen or tighten the string 11 on tuning pin 17. The other tuning key gears act similarly.

Figure 3:
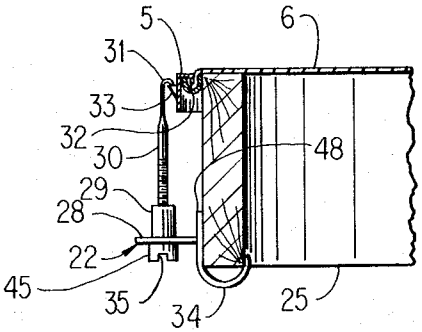
FIG. 3 is a partial sectional view taken at Section 3—3 of FIG. 1.

FIG. 3 is a partial sectional view taken at Section 3—3 of FIG. 1. Banjo head membrane 6 is held by head membrane retainer ring 32. Head membrane retainer ring 32 may be a concave piece extending around the circumference of banjo body 25. In any case, the head membrane retainer ring 32 would extend circumferentially around banjo body 25. Banjo head rim 5, which extends along the entire circumference of the upper portion of the banjo assembly 2, holds down the head membrane retainer ring 32. The upper end of head rim 32 is hook shaped or downwardly concave in cross-section and engages the upwardly concave head retainer ring 32, fitting within its concave cross-section. The banjo head membrane 6 may be secured in any desired manner onto the head membrane retainer ring 32. The head membrane retainer ring 32 may also be utilized as a base on which the banjo head membrane 6 may be held upon downward pressure by the banjo head rim 5.

The banjo head rim 5 has a connection slot 33. Tuning lug assembly 22 has tuning lug screw 30 with a hooked section 31. The tuning lug screw 30 fits into adjusting screw nut 29. Adjusting screw nut 29 has interior threads within which tuning lug screw 30 may be loosened or tightened, and has a screwdriver slot 35. Adjusting screw nut 29 has an enlarged base 45. Shoulder 28 is physically secured to u-clamp 34. Shoulder 28 rests upon enlarged base 45 of adjusting screw nut 29. U-clamp 34 fits under banjo body 25.

Figure 4:
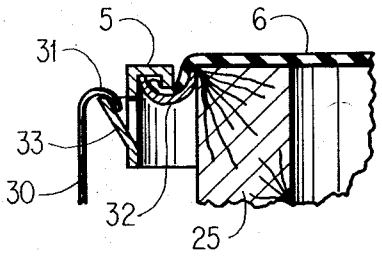
FIG. 4 is a partial enlarged sectional view of the portion of tuning lug screw 30 connected to banjo head rim 5.

FIG. 4 is a partial enlarged sectional view of the portion of tuning lug screw 30 connected to banjo head rim 5. FIG. 4 shows that the hooked section 31 of tuning lug screw 30 fits within the connection slot 33 of banjo head rim 5, thereby avoiding contact with head membrane 6. When downward pressure is on tuning lug screw 30, hooked section 31 brings downward pressure on connection slot 33. Connection slot 33 transfers the downward pressure to banjo head rim 5. Banjo head rim 5 pulls downward on the head membrane retainer ring 32 and the banjo head membrane 6, thereby; tightening the banjo head membrane 6. When tuning lug screw 30 has less downward pressure, the reverse occurs and the banjo head membrane 6 is loosened. By tightening or loosening the plurality of tuning lug assemblies 22 around the banjo body assembly 2, the banjo head membrane 6 may be loosened or tightened for desired sound quality for the banjo 1.

Figure 5:
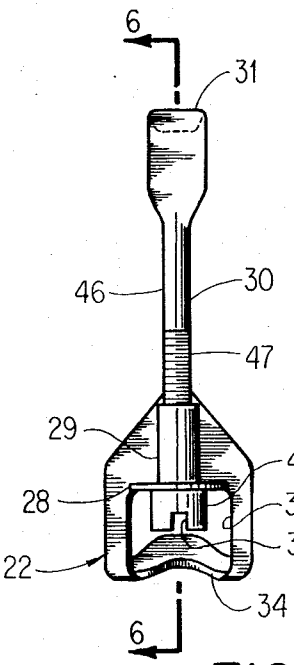
FIG. 5 is a front elevational view of tuning lug assembly 22.

FIG. 5 is a front elevational view of tuning lug assembly 22. Tuning lug assembly 22 comprises tuning lug screw 30, adjusting screw nut 29, and holdng means comprising shoulder 28 secured to u-clamp 34. The tuning lug screw 30 comprises a hooked section 31, a shaft 46, and a threaded portion 47. Hooked section 3 has a wedge shape, illustrated in phantom in FIG. 5, which fits within connection slot 33 and conforms to its general configuration.

Figure 6:
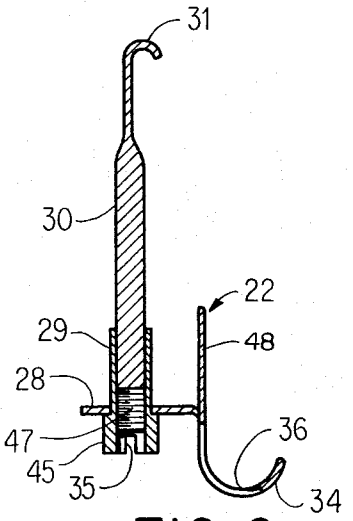
FIG. 6 is a sectional view taken at Section 6—6 of FIG. 5 of the tuning lug assembly 22.

FIG. 6 is a sectional view taken at Section 6—6 of FIG. 5 of the tuning lug assembly 22. The u-clamp 34 has an opening 36 into which the banjo body 25 is secured. The upward and downward movement of the adjusting screw nut 29 may be controlled by a simple screwdriver utilized within screwdriver slot 35 in adjusting screw nut 29. Shoulder 28 is rigidly secured to u-clamp 34. U-clamp 34 has an upper u-clamp extension 48 which presses against the side of banjo body 25 to aid in securing tuning lug asssembly 22 to banjo body 25.

Figure 7:
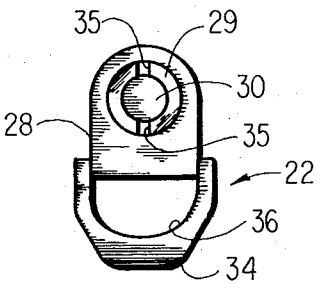
FIG. 7 is a bottom elevational view of tuning lug assembly 22.

FIG. 7 is a bottom elevational view of tuning lug assembly 22. The screwdriver slot 35 is easily utilized to adjust adjusting screw nut 29 to raise or lower the holding means, including shoulder 28 and u-clamp 34.

Figure 8:
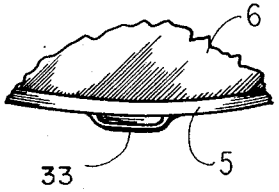
FIG. 8 is a partial enlarged elevational view of a portion of banjo 1 including head rim connection slot 33.

FIG. 8 is a partial enlarged elevational view of a portion of banjo 1, including head rim connection slot 33. Banjo head membrane 6 is shown held down by banjo head rim 5. A connection slot 33 is shown in banjo head rim 5. Connection slot 33 is the connecting point for the hooked section 31 of tuning lug screw 30.

Figure 9:
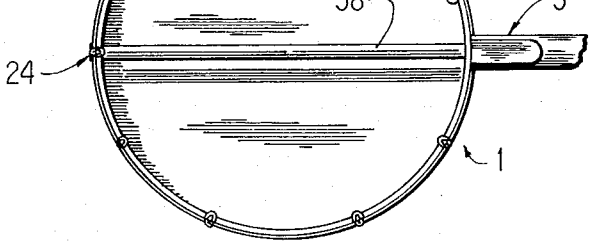
FIG. 9 is a partial bottom elevational view of banjo 1.

FIG. 9 is a partial bottom elevational view of banjo 1. Bracing dowel 38 extends across the diameter of the banjo body assembly 2. The banjo head rim 5 extends along the entire circumference of the upper portion of banjo body assembly 2. A plurality of tuning lug assemblies 22 are located around the circumference of the banjo body 25. The tailpiece lug assembly 24 is secured to the banjo head rim 5 and the banjo body 25, aligned with banjo neck 3 of the banjo 1.

Figure 10:
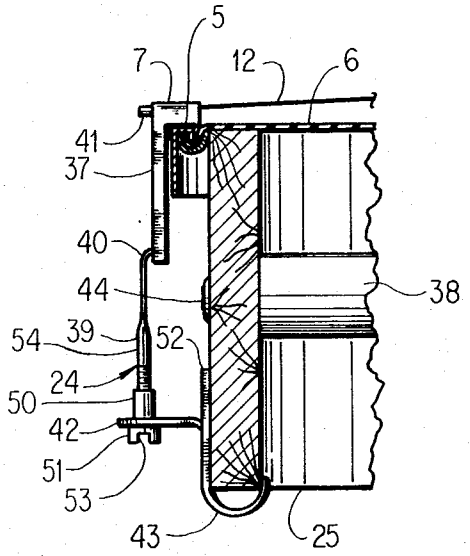
FIG. 10 is an enlarged sectional view of the portion of banjo 1 including tailpiece 7.

FIG. 10 is an enlarged sectional side view of the portion of banjo 1 including tailpiece 7. Tailpiece 7 has a string anchor 41. Tailpiece 7 has a vertical portion 37 with slotted opening 49. Connected to tailpiece 7 is adjusting screw 39 comprising a shaft 54, a threaded portion 55, and a hooked section 40. Adjusting screw 39 with hooked section 40 is utilized in the tailpiece lug assembly 24.

Tailpiece lug assembly 24 has an adjusting screw 39, an adjusting screw nut 50, and holding means including shoulder 42 and u-clamp 43. U-clamp 43 has an upper u-clamp extension 52 which aids u-clamp 43 in holding banjo body 25. Adjusting screw nut 50 has enlarged base 51 on which shoulder 42 rests. Vertical portion 37 of tailpiece 7 has a slotted opening 49 in which hooked section 40 of adjusting screw 39 secures. Bracing dowel 38 is secured by a bracing dowel anchor 44. Enlarged base 51 of adjusting screw nut 50 has a screwdriver slot 53.

Adjusting screw 39 is similar to adjusting screw 30. Hooked section 40 is similar to hooked section 31. Adjusting screw nut 50 is similar to adjusting screw nut 29. Shoulder 42 is similar to shoulder 28. U-clamp 43 is similar to u-clamp 34. Upper u-clamp extension 52 is similar to upper u-clamp extension 48. All portions of tailpiece lug assembly 24 are similar to the similar portions of the plurality of tuning lug assemblies 22.

Banjo 1 is essentially made by combining a banjo neck 3 with a banjo body assembly 2. Banjo body assembly 2 is similar to a tamborine. The tamborine could be either a tunable or a non-tunable model.

The tuning lug assembly 22 contains various unique features. Tuning lug assembly 22 has a screwdriver slot 35 for tightening or loosening the tuning lug assembly 22. No wrench is required for adjustment. The tuning lug assembly 22 has a unique holding means for holding the tuning lug assembly 22 onto the banjo body 25. The holding means comprises shoulder 28 rigidly secured to u-clamp 34 with an upper u-clamp extension 48. The banjo head rim 5 is tightened or loosened from the bottom of the banjo body assembly 2 by utilizing the tuning lug assembly 22. No nut anchoring device is needed since the tuning lug assembly 22 tightens the banjo head membrane from the bottom of the banjo body assembly 2. The tuning lug assembly 22 is a side anchoring device which is not mounted through the banjo body 25.

The banjo head rim hook slot or interlocking connection slot 33 is formed directly into the banjo head rim 5. The connection slot 33 or hook slot 33 prevents the hooked section 31 of tuning lug screw 30 from slipping from side-to-side, while permitting ready withdrawal of hooked section 31 from connection slot 33. Since the connection slot 33 is in the side of the banjo head rim 5, the tightening or loosening occurs from the side, not from the top. The height of the banjo head membrane, as shown in FIG. 2, is higher than the height of the banjo head rim and the plurality of tuning lug assemblies 22. The higher head gives a unique sound compared to a banjo body assembly with the head recessed below the banjo head membrane.

The tailpiece 7 anchors the plurality of strings to the banjo body 25. The tailpiece lug assembly 24 allows the tailpiece 7 to move side-to-side in order to allow a more perfect string alignment with the banjo neck 3, while the action of upper clamp extension 52 and the action of the upper portion of tailpiece 7, which is secured to head rim 5, combine to clamp tailpiece 7 from rocking to and fro. Such clamping serves to hold tailpiece 7 in place independent of string tension. This adjustment is not available on banjos with a rigidly mounted bridge 8.

The invention provides a musical instrument with a head membrane which can be adjusted from the bottom of the body assembly. Head rim hook slots are provided on the head rim of the body assembly. A plurality of hooks fit into the plurality of head rim hook slots to adjust the tension on the head membrane from the side of the head rim. The height of the head membrane is higher than the height of the head rim. The tailpiece is adjusted side-to-side allowing for proper string alignment with the neck of the musical instrument. The musical instrument is made by combining a banjo neck with a banjo body assembly similar to a tamborine, but with unique adjusting features.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. In a musical instrument having a body including a bottom, a neck, a headpiece, a plurality of strings and a head membrane, the combination comprising:

(a) a membrane retaining means to which said membrane is secured, (b) head rim means fitting over said membrane retaining means and engaging said membrane retaining means, said head rim means including a plurality of slot means, (c) a plurality of adjustable tuning means having upper and lower portions, said tuning means being held in place against side to side movement by corresponding ones of said slot means releasably engaging said upper portion of said tuning means, said plurality of adjustable tuning means functioning to adjust said head membrane from the bottom of said body, and (d) adjustable tailpiece means constructed to allow side to side movement to provide easy proper alignment of said strings.

2. A musical instrument in accordance with claim 1, wherein said membrane retaining means is upwardly concave and the upper portion of said head rim means is downwardly concave.

3. A musical instrument in accordance with claim 1, wherein said slots provided on said head rim means allow vertical withdrawal of said tuning means.

4. A musical instrument in accordance with claim 3, wherein said slots extend outwardly from a periphery of said head rim.

5. A musical instrument in accordance with claim 4, wherein said slots are so constructed as to hold said tuning means away from and out of contact with said head membrane.

6. A musical instrument in accordance with claim 5, wherein the internal dimensions of each said slot correspond to the dimensions of a wedge-shaped upper end portion of said tuning means, thereby constraining said end portions within said slots against side to side motion.

7. A musical instrument in accordance with claim 1, wherein said tailpiece means is adjustably secured to said head rim means and to the body of said musical instrument to provide proper alignment of said strings.

8. A musical instrument in accordance with claim 7, wherein said tailpiece means includes first upper engaging means constructed to engage an upper surface of said head rim means and second lower engaging means constructed to engage a lower edge of said body.

9. A musical instrument in accordance with claim 8, wherein said tailpiece means includes adjustable means constructed to hold said tailpiece means firmly in place when adjusted.

10. A musical instrument in accordance with claim 9, wherein said tailpiece means is so constructed as to prevent said tailpiece from rocking to and fro in a vertical plane but to allow releasable motion from side to side.

11. A musical instrument in accordance with claim 10, wherein said tailpiece means is held in place independent of string tension.

12. A musical instrument with a plurality of strings, comprising (a) a body assembly upon which a plurality of strings is adjustably secured, said body assembly including a bottom;

(b) a neck, rigidly secured to said body assembly, over which said plurality of strings passes; and (c) a head piece, rigidly secured to said neck, to which said plurality of strings is adjustably secured;

wherein said body assembly comprises:

(1) a cylindrical body;

(2) a membrane covering the top of said cylindrical body;

(3) an upwardly concave head membrane retainer ring to which said membrane is secured, said membrane retainer ring extending circumferentially around an outer face of said body;

(4) a head rim movably fitted over said membrane retainer ring, said head rim having an upper end portion downwardly concave in cross section in engaging relationship with said membrane retainer ring and being so constructed as to transmit variable forces applied to said head rim to said membrane retainer ring;

(5) a plurality of outwardly extending connecting slots on an outer side of said head rim; and (6) a plurality of tuning means which function to adjust said membrane from the bottom of said body, said tuning means including an upper portion and a lower portion, said upper portion being so constructed as to become firmly held within said connecting slots in a fixed position and constrained from moving from side to side.

13. A musical instrument in accordance with claim 12, wherein said tuning lugs have a connecting structure so constructed as to interlock with said connecting slots.

14. A musical instrument in accordance with claim 1, wherein said lower portion of said tuning means comprises a holding means which includes a first portion and a second portion, said second portion of said holding means being releasably secured under the bottom of said body.

15. A musical instrument in accordance with claim 14, wherein said second portion of said holding means is a clamp in a general U-shape.

16. A musical instrument in accordance with claim 12, wherein said lower portion of said tuning means comprises a holding means which includes a first portion and a second portion, said second portion of said holding means being secured under the bottom of said body.

17. A musical instrument in accordance with claim 16, wherein said second portion of said holding means is a clamp in a general U-shape.

* * * * *